United States Patent [19]

Baroody

[11] 3,949,700

[45] Apr. 13, 1976

[54] TRIM ADJUSTMENT FOR A JET BOAT

[76] Inventor: Anas J. Baroody, No. 8 Nobview Circle, Little Rock, Ark. 72201

[22] Filed: May 13, 1971

[21] Appl. No.: 143,064

[52] U.S. Cl. ..... 115/12 R; 239/265.23

[51] Int. Cl.[2] ..... B63H 11/10

[58] Field of Search ..... 115/12 R, 14, 16; 60/221, 60/222; 239/265.19, 265.23, 265.35

[56] References Cited

UNITED STATES PATENTS

| | | | |
|---|---|---|---|
| 2,998,262 | 8/1961 | Hoffman | 403/127 |
| 3,040,525 | 6/1962 | Cochran | 115/12 R X |
| 3,266,733 | 8/1966 | Goehler | 115/16 X |
| 3,475,912 | 11/1969 | Angier | 115/14 X |
| 3,788,265 | 1/1974 | Moore | 115/12 R |

*Primary Examiner*—Trygve M. Blix
*Assistant Examiner*—Edward R. Kazenske

[57] ABSTRACT

A trim adjustment for a jet boat where a deflector positioned in the jet stream, is adjustable in a vertical plane to adjust the trim of the boat. The mounting of the deflector involves the use of universal pivots, whereby the deflector may also be adjusted in a horizontal plane to control steering of the craft.

10 Claims, 3 Drawing Figures

ANAS J. BAROODY
INVENTOR.

BY

Edward Brosler
ATTORNEY

ANAS J. BARODY
*INVENTOR.*

BY *Edward Brosler*
ATTORNEY

TRIM ADJUSTMENT FOR A JET BOAT

My invention relates to boats and more particularly to jet propelled craft.

Important to the functioning of a boat is its trim or attitude when in motion. At different speeds of travel, its attitude changes, but at any speed, efficiency will be a function of the attitude.

The attitude of a boat in motion at any speed is determined when the sum of the moments about the center of gravity of the boat and its load, arrives at a condition of equilibrium or in other words, when the sum of such moments equals zero.

The resulting force on a planing hull of a marine jet boat may cause an improper and undesirable attitude such as (a) a high trim angle, preventing the boat from planing or achieving maximum speed, (b) a low trim angle, causing an increase of drag with an accompanying loss of power, or (c) instability in the attitude of the boat causing an oscillation thereof between a high and low angle, which is commonly referred to as a porpoising action.

Among the objects of my invention are:

1. To provide a novel and improved trim adjustment for a jet propelled boat;

2. To provide a novel and improved trim adjustment for a jet propelled boat, which can be readily altered to correct for such factors as may adversely affect the efficient attitude of the boat while in motion;

3. To provide a novel and improved trim adjustment for a jet propelled boat which lends itself to remote control;

4. To provide a novel and improved trim adjustment for a jet propelled boat, which can also be employed for use in steering the craft.

Additional objects of my invention will be brought out in the following description of a preferred embodiment of the same, taken in conjunction with the accompanying drawings wherein, FIG. 1 is a view depicting the various forces and moments involved in determining the attitude assumed by a boat while in motion;

Figures 1, 3:
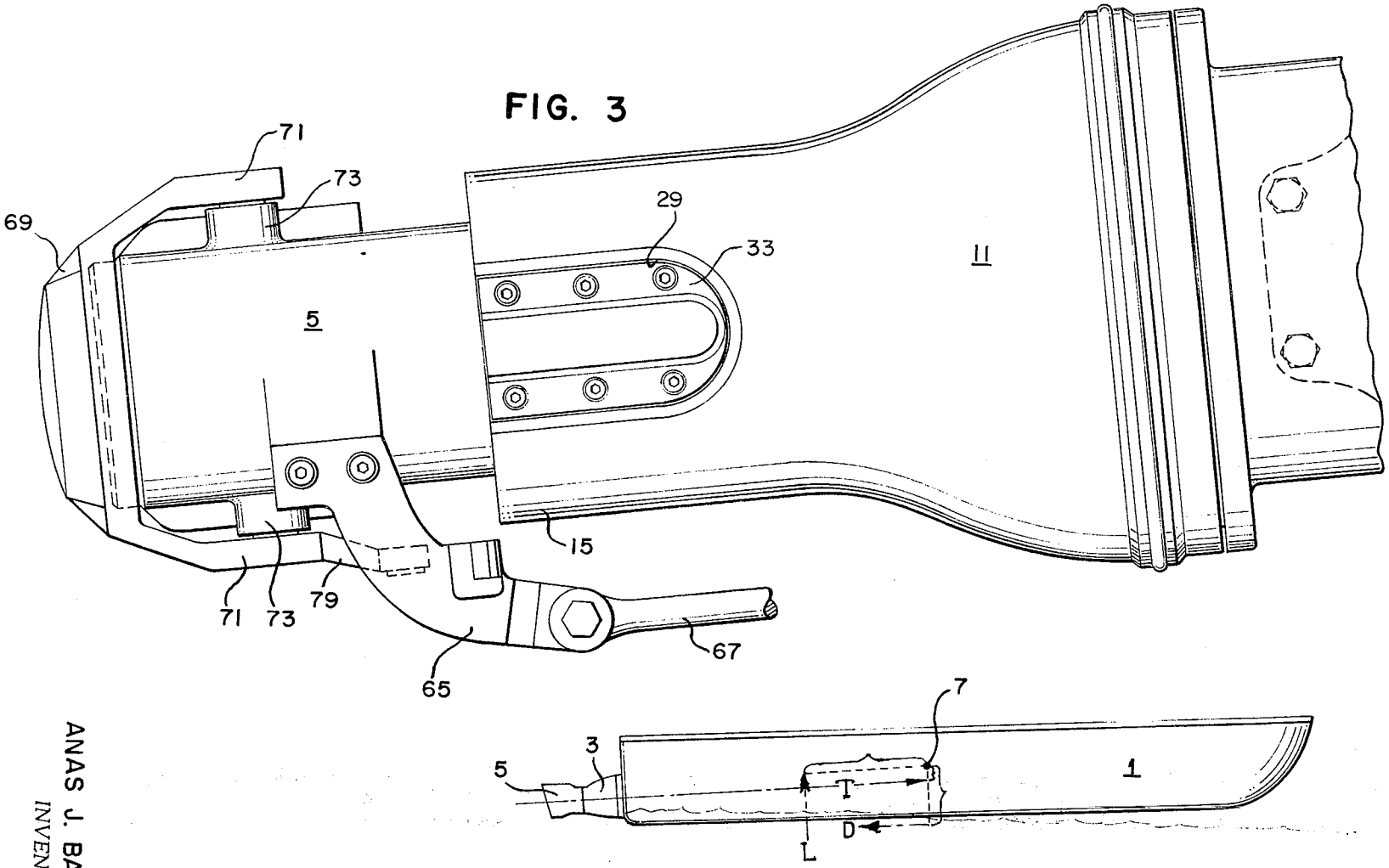
FIG. 3 is a plan view of the trim adjustment of FIG. 2.
Figure 2:
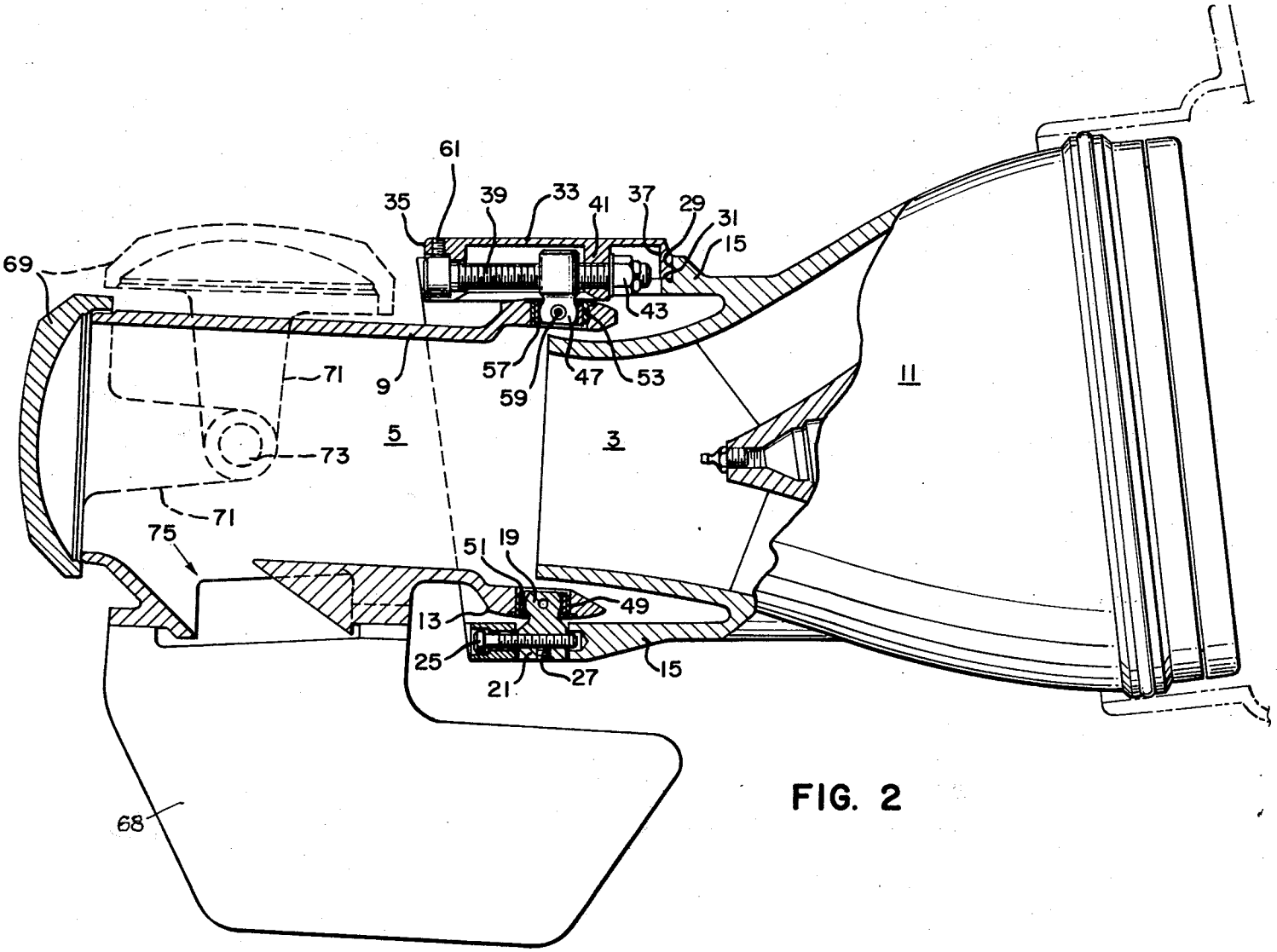
FIG. 2 is a longitudinal view in section along the longitudinal axis of the trim adjustment of the present invention, in relationship to the jet power plant of a jet propelled boat.

Referring to the drawings for details of my invention in its preferred form, attention is directed to FIG. 1 wherein there is disclosed a hull 1 with a jet nozzle 3 extending through the stern thereof, and to which is affixed the trim adjustment 5 of the present invention.

Such hull, considered in conjunction with any prevailing load, will have a center of gravity somewhere intermediate the ends of the hull and more likely toward the middle thereof. All forces acting on the hull may be considered as acting about the center of gravity, on moment arms normal to these forces, and may be considered in terms of the average of such forces and the moment arm normal thereto and which passes through the center of gravity.

The forces normally acting on a planing hull are the "jet reaction thrust" force T, a "lift" force L, and a "drag" force D, the jet reaction thrust moment being opposed by both the lift force moment and the drag force moment all acting about the center of gravity. Under any prevailing condition, the attitude of the boat is determined when the moments about the center of gravity balance out and equilibrium is established. Such equilibrium, however, as previously indicated, does not necessarily establish the most efficient attitude of the hull under the existing conditions, and in accordance with the prior practice, changes in attitude to achieve greater efficiency, were accomplished through shifting of weights fore and aft, or through the installation of external trim tabs at the stern of the hull. Both of these methods result in added drag to the craft.

Broadly, the objects of the present invention are attained through altering the moment arm of the jet reaction thrust force, whereby the moment attributable to this force may be increased or decreased to establish a change in attitude of the hull until a new and desired state of equilibrium is established.

Toward this end, I provide a deflector 9, preferably of tubular shape and of a diameter corresponding to that of the jet nozzle of the power plant with which the deflector is to be associated.

The nozzle is located at the end of the power plant 11, but insofar as the power plant details are concerned, they are not critical to the present invention, and such details have, accordingly, not been illustrated.

The deflector, at one end, is mounted to the end of the nozzle, and at this end, is somewhat enlarged in diameter to form a collar 13 which can telescope over the discharge end of the nozzle, to encourage full discharge from the nozzle into the deflector.

To providing for such mounting of the deflector, the nozzle is cast with an integral outside cylindrical flange 15 extending beyond the discharge end of the nozzle, and of a diameter to envelop the proximate end of the deflector.

With the deflector positioned as described, and with adequate clearance provided, it is free to move angularly in a vertical plane. To retain the deflector in such position relative to the nozzle, and at the same time enable such movement in the vertical plane, a pivot support 17 is installed in the nozzle flange just below the discharge end of the nozzle, the pivot included in such support being preferably a ball pivot 19 having a base 21 provided with a threaded diametrical passageway therethrough to receive a mounting screw 25 extending into a passageway provided into the edge of the flange. A set screw 27 extending upwardly into the base of this ball pivot and into engagement with the installing screw, will serve to lock such screw against accidental withdrawal. This ball pivot, once installed, is thus fixed as to position.

In the flange 15 above the nozzle, the flange is provided with a substantially rectangular opening or notch 29 bounded by an internal shoulder 31, to receive and support a cap 33 adapted to be bolted to the flange following insertion thereof into the opening.

This cap includes opposed end walls 35, 37, that end wall 35 which is outermost, being recessed to house the head end of a bolt 39, the other end of the bolt passing through a partition 41 intermediate the ends of the cap but closer to the innermost end, but spaced therefrom sufficiently to permit of the application of nut 43 to this end of the bolt. The passages through the end wall 35 and partition 41 in which this bolt is supported, are unthreaded, thus permitting free rotation of the bolt without any resulting longitudinal movement of the bolt in its installed position within the cap.

Threadedly mounted on the bolt in an inverted position, between the end wall 35 and partition 41, is a ball pivot 47 similar to that installed in the flange below the lowermost edge of the nozzle. Any rotation of the bolt on which the pivot is threaded, will cause translatory movement of this pivot.

At its lowermost point in the collar portion thereof, the deflector is provided with a hole to receive the fixed ball pivot 19, such hole being sufficiently oversized to receive a sleeve bearing 49 lining the wall of the hole, and a collar 51 installed between this bearing and the pivot ball.

At the uppermost point, and in the collar portion of the deflector, a similar oversize opening is provided to receive the inverted ball pivot 47, a like sleeve bearing 53 and an intervening collar 57. In this instance, however, the ball pivot and its associated collar are pinned together by a pin 59 running diametrically through the ball pivot, to retain the collar in its assembled position.

With the deflector thus installed, it will be apparent that the inverted pivot and its associated adjusting mechanism constitute a means for angularly tilting the deflector about the lower fixed pivot, while retaining the proximate end of the deflector in alignment with the nozzle, whereby this end of the deflector will always lie in the full flow path of the nozzle discharge, regardless of the prevailing adjustment angle thereof.

To assure maintenance of any angular adjustment of the deflector, a set screw 61 threaded into the cap 33 at a point where it will engage the head of the adjusting bolt 39, will preclude accidental rotation of such adjusting bolt and thus maintain the angular position of the deflector.

Such angular deflections of the deflector might conceivably have also been obtainable by mounting the deflector on a hinge pin passing through the discharge end of the nozzle, or on a hinge pin installed in place of the lower pivot ball, but in the present preferred embodiment of the invention, I have intentionally chosen to utilize the ball pivots or equivalents thereof which permit of substantially universal movement of the deflector, or at least movement in a horizontal plane in addition to the permissible movement in a vertical plane. With such universal movement, the deflector may then also be utilized to bring about angular deflections of the nozzle discharge in a horizontal plane for steering purposes.

With this in mind, a steering arm or bracket 65 may be affixed to the deflector, to which a control rod 67 may be pivotally connected. When thus utilized for steering, a rudder 68 may be added or integrally formed with the deflector to assist in the steering. Such rudder also becomes useful when coasting with power off, as when approaching a dock for a landing.

The deflector described above, also lends itself to the application of a reversing gate 69 of the type disclosed in the patent to Raymond E. Horan, Jr. for Jet Propulsion Drive For Ships, U.S. Pat. No. 3,422,788 of Jan. 21, 1969. Such gate includes a pair of spaced parallel radial arms 71, and straddles the deflector to which it is pivotally mounted in side bearings 73 carried by the deflector, thus permitting the gate to be rotated from an upper horizontal out-of-the-way position, to a position in the flow path of the discharge from the deflector.

When provided with such reversing gate, the lower intermediate portion of the deflector is provided with one or more openings 75, whereby the jet discharge in striking the gate will be caused to reverse its direction and discharge through the opening in the bottom of the deflector to reverse the craft. By controlling the position of the gate, the discharge from the nozzle may be apportioned in varying degrees, between that which results in maximum forward motion of the craft and that which causes maximum motion in reverse. Thus one may utilize the gate to slow down the craft, or place it in neutral, or reverse the same at an increasing rate. To adjustably position the reversing gate to accomplish such results, the gate at its pivot axis, is provided with an adjusting lever 79 to which may be affixed, a control rod (not shown).

It will be appreciated from the foregoing description, that the ball pivot mountings for the deflector, function in the nature of universal joints, permitting adjustment of the deflector in both the vertical and horizontal planes, the adjustments in the vertical plane enabling one to trim the boat to realize a more efficient attitude while in motion, while the adjustments in the horizontal plane enable steering of the craft.

While the mechanism for obtaining trim adjustment, as disclosed, is for the purpose of accomplishing a permanent adjustment, it will be apparent that arrangements may readily be made for accomplishing rotation of the adjusting bolt 39 from a remote position, whereby adjustments may be effected to alter the attitude of the craft to accommodate prevailing loads such as a water skier, which might have a tendency to change the attitude of the craft to one of less efficiency, if not compensated for.

The ability to alter the trim of the boat in the manner provided for by the present invention, enables the objects of the invention to be easily realized and without adding unnecessarily to the drag on the boat.

While the invention has been described in its preferred form, it is subject to alteration and modification without departing from the underlying principles involved and I do not desire to be limited in my protection to the specific details illustrated and described except as may be necessitated by the appended claims.

I claim:

1. A jet boat control for a jet boat powered by a power plant having means for producing a jet stream, and terminating in a jet nozzle, said jet boat control comprising a single unit substantially tubular deflector component, means pivotally supporting said single unit tubular deflector component at one end about an axis in substantially the plane of the discharge end of said jet nozzle for steering purposes, said single unit deflector component having an opening, and means for tilting said pivotal supporting means and axis in a substantially vertical plane, for adjusting said single unit tubular deflector component in a substantially vertical plane for trimming said boat.

2. A jet boat control for a jet boat powered by a power plant having means for producing a jet stream and terminating in a nozzle, said jet boat control, comprising a single unit jet stream deflector component having a substantially circular input end substantially in the plane of the discharge end of said nozzle, pivot means, having an axis also in substantially the plane of the discharge end of said nozzle, supporting said single unit deflector component in said relationship to said nozzle and said pivot means, allowing for movement of said single unit deflector component with respect to said nozzle in a horizontal plane for steering, and adjusting mechanism means for tilting said pivot means and its axis in a vertical plane, whereby to enable trim adjustment.

3. A jet boat control in accordance with claim 2, characterized by jet reversing means disposed for operation at the discharge end of said deflector component, whereby steering by means of said deflector component will not be impaired by said reversing means in its reversing position.

4. A jet boat trim adjustment for a jet boat powered by a power plant having means for producing a jet stream and terminating in a nozzle, said jet boat trim adjustment, comprising a single unit jet stream deflector component having a substantially circular input end substantially in the plane of and larger in diameter than the discharge end of said nozzle to assure total discharge and maximum input of jet power from said nozzle into said single unit deflector component, means supporting said single unit deflector component in said relationship to said nozzle and for movement with respect to said nozzle in both a vertical and horizontal plane, whereby to enable steering as well as trim adjustment, said supporting means including a pair of universal mountings, one of said mountings being located at substantially the lowermost point of said deflector component in substantially the plane of the discharge end of said nozzle and the other diametrically opposite thereto.

5. A jet boat trim adjustment in accordance with claim 4, characterized by means for adjustably shifting said diametrically opposite universal mounting in a longitudinal direction.

6. A jet boat trim adjustment for a jet boat powered by a power plant having means for producing a jet stream and terminating in a jet nozzle, said jet boat trim adjustment comprising means for adjustably deflecting the said jet stream in a vertical plane, said adjustable deflecting means including a deflector of generally tubular shape, means tiltably supporting said deflector for tilting in a vertical plane, with one end in proximity to the discharge end of said nozzle, said tiltably supporting means including a first universal connection between said deflector at substantially the lowermost point on the said end thereof and said nozzle, and vertical adjusting means diametrically opposite said universal connection and between said deflector and said nozzle, said adjusting means including a second universal connection, whereby said deflector is also capable of adjustment in a horizontal plane to enable steering, the lower of said universal connections including a pivot ball, means supporting said pivot ball below the rim of said nozzle, said deflector having an oversize hold into which said pivot ball extends, a bearing lining the wall of said hole, and a collar installed between said bearing and said pivot ball.

7. A jet boat trim adjustment in accordance with claim 6, characterized by said second universal connection including an inverted pivot ball, means adjustably supporting said pivot ball above the rim of said jet nozzle and for adjustment in a substantially horizontal direction paralleling the axis of said jet nozzle, said deflector having an oversize hole into which said pivot ball extends, a bearing lining the wall of said hole, a collar installed between said bearing and said pivot ball, and a pin through said collar and ball.

8. A jet boat trim adjustment in accordance with claim 7, characterized by said pivot ball adjustable supporting means including a threaded bolt threadedly passing through the base of said pivot ball, means rotatably supporting said bolt at spaced points to either side of said pivot ball, and means restraining longitudinal movement of said bolt during rotation thereof, whereby to cause movement of said pivot ball along said bolt in a direction depending upon the direction of rotation of said bolt, to effect an angular adjustment of said deflector about said pivot support.

9. A jet boat trim adjustment in accordance with claim 7, characterized by said pivot ball adjustable supporting means including a threaded bolt threadedly passing through the base of said pivot ball, means rotatably supporting said bolt at spaced points to either side of said pivot ball, and means restraining longitudinal movement of said bolt during rotation thereof whereby to cause movement of said pivot ball along said bolt in a direction depending upon the direction of rotation of said bolt to effect an angular adjustment of said deflector about said pivot support, and means for adjusting said deflector in a substantially horizontal plane to effect steering of such jet boat.

10. A jet boat control for a jet boat powered by a power plant having means for producing a jet stream and terminating in a nozzle, said jet boat control, comprising a single unit jet stream deflector component having a substantially circular input end substantially in the plane of and larger in diameter than the discharge end of said nozzle to assure total discharge and maximum input of jet power from said nozzle into said single unit deflector component, means supporting said single unit deflector component in said relationship to said nozzle and for movement with respect to said nozzle in both a vertical and horizontal plane, whereby to enable steering as well as trim adjustment, said supporting means including a pair of univeral mountings, one of said mountings being located at a point of said deflector component in substantially the plane of the discharge end of said nozzle and the other diametrically opposite thereto.

* * * * *